US005781929A

United States Patent [19]

Shikatani

[11] Patent Number: 5,781,929

[45] Date of Patent: Jul. 21, 1998

[54] HOCKEY GOALTENDER'S GLOVE WITH FLEXIBLE CUFF

[75] Inventor: Brian H. Shikatani, Milton, Canada

[73] Assignee: Canstar Sports Group Inc., Quebec, Canada

[21] Appl. No.: 812,327

[22] Filed: Mar. 5, 1997

Related U.S. Application Data

[63] Continuation of Ser. No. 386,535, Feb. 10, 1995, abandoned.

[51] Int. Cl.[6] ..... A41D 13/10

[52] U.S. Cl. ..... 2/16; 2/161.1; 2/162

[58] Field of Search ..... 2/16, 19, 20, 159, 2/160, 161.1, 162

[56] References Cited

U.S. PATENT DOCUMENTS

| | | | |
|---|---|---|---|
| 246,259 | 8/1881 | Whitaker | 2/162 |
| 1,519,913 | 12/1924 | Hynes | 2/162 |
| 4,677,698 | 7/1987 | Angas | 2/16 |
| 4,967,418 | 11/1990 | Marcotte | 2/16 |
| 5,511,243 | 4/1996 | Hall et al. | 2/16 |
| 5,511,244 | 4/1996 | Shikatani | 2/16 |

FOREIGN PATENT DOCUMENTS

| | | | |
|---|---|---|---|
| 1272352 | 8/1990 | Canada | 2/16 |
| 2035824 | 8/1992 | Canada | 2/16 |

*Primary Examiner*—Micheal A. Neas

*Attorney, Agent, or Firm*—Finnegan, Henderson, Farabow, Garrett & Dunner, L.L.P.

[57] ABSTRACT

A hockey goaltender's glove is described, in which the outer cuff thereof is divided into three segments, namely a central segment and two lateral segments, and in which the central segment is connected to the lateral segments along edges thereof, via elastic webbing. The central segment thus may be readily flexed outwardly and away from the lateral segments, thereby providing improved flexibility of the cuff, to improve the goaltender's ability to smother the puck, without unduly sacrificing protection of the wrist and forearm area.

7 Claims, 2 Drawing Sheets

HOCKEY GOALTENDER'S GLOVE WITH FLEXIBLE CUFF

This is a continuation of application Ser. No. 08/386,535, filed Feb. 10, 1995, now abandoned.

BACKGROUND OF THE INVENTION

This invention relates to ice hockey equipment, and in particular to goaltender's gloves.

A goaltender's glove is used primarily to catch a flying puck, or to "smother" a puck on the ice by covering it with the glove, and also to assist in handling the goaltender's stick to "clear" or pass the puck to a player.

So that the goaltender or "goalie" can smother a puck on the ice, to assist in stickhandling, and to improve the manipulability of the glove generally, it is desirable to have a flexible cuff. In smothering the puck, for example, a flexible cuff would permit the goalie to reach straight down to the ice, and flatten his palm and the glove over the puck without being unduly restricted by the cuff of the glove.

However, in conventional gloves, the cuff is quite rigid, in keeping with the need to protect the wrist and forearm area against injury from impact from the puck.

SUMMARY OF THE INVENTION

It is an object of the invention to provide a goaltender's glove with improved flexibility of the cuff, without unduly sacrificing protection of the wrist and forearm area.

In the invention, the glove has a cuff in which one segment thereof is connected to the segments on either side thereof via elastic webbing. The segments normally overlap each other to provide substantially normal protection for the wrist and forearm area. However, when the goaltender rotates his hand backwardly towards the forearm, such as when reaching down and flattening his hand against the ice, the segment flexes away from the other segments, by virtue of the elastic webbing, so that there is minimal interference with this and other such movements.

Further features will be described or will become apparent in the course of the following detailed description.

BRIEF DESCRIPTION OF THE DRAWINGS

The invention will now be described in greater detail with reference to the accompanying drawings, in which.

DETAILED DESCRIPTION OF THE PREFERRED EMBODIMENT

Figure 1:
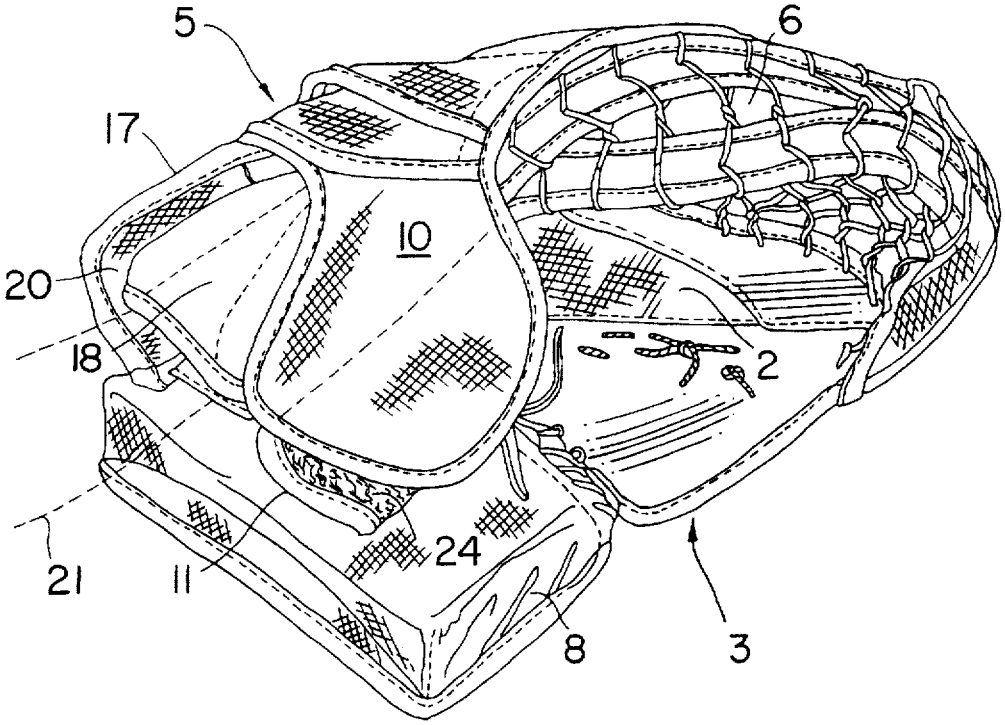
FIG. 1 is a perspective of the back of the glove.

The glove is conventional in most respects, having a main glove portion including a thumb receiving portion 2, a finger receiving portion 4, and a pocket 6. The glove also comprises a palm side 3 and a back side 5. A first cuff portion 8 adjoins the glove portion for protecting the palm side of the wrist and lower forearm of the goaltender and a second cuff portion 10 is provided across the back side 5 of the glove for protecting the back side of the wrist and lower forearm of the goaltender. There is a hand opening 12 for the goalie's hand to be inserted, and securing straps 14 which are tightenable across the back of the goalie's hand to ensure a secure grip on the glove. The securing straps 14 are tightenable and fastenable via hook and pile fastening material, such as VELCRO (trademark). Preferably, there is also a removable wrist pad 16, also secured via VELCRO.

The second cuff portion 10 is sewn to the first cuff portion 8 at one edge, with the opposite side being secured via VELCRO fastening material to a flap 11 sewn at one edge to the back of the first cuff portion 8. This VELCRO fastening includes hook portion 22 and pile portion 24.

Figure 2:
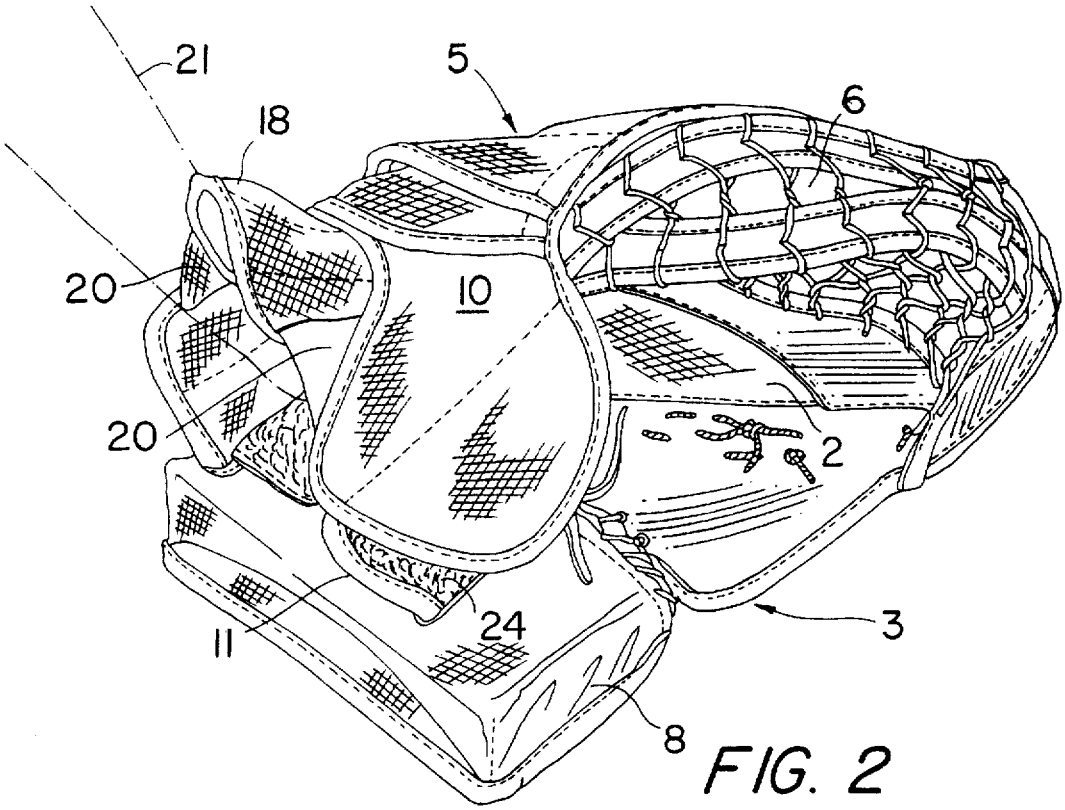
FIG. 2 is a perspective of the back of the glove, showing the cuff flexed upwardly.
Figure 3:
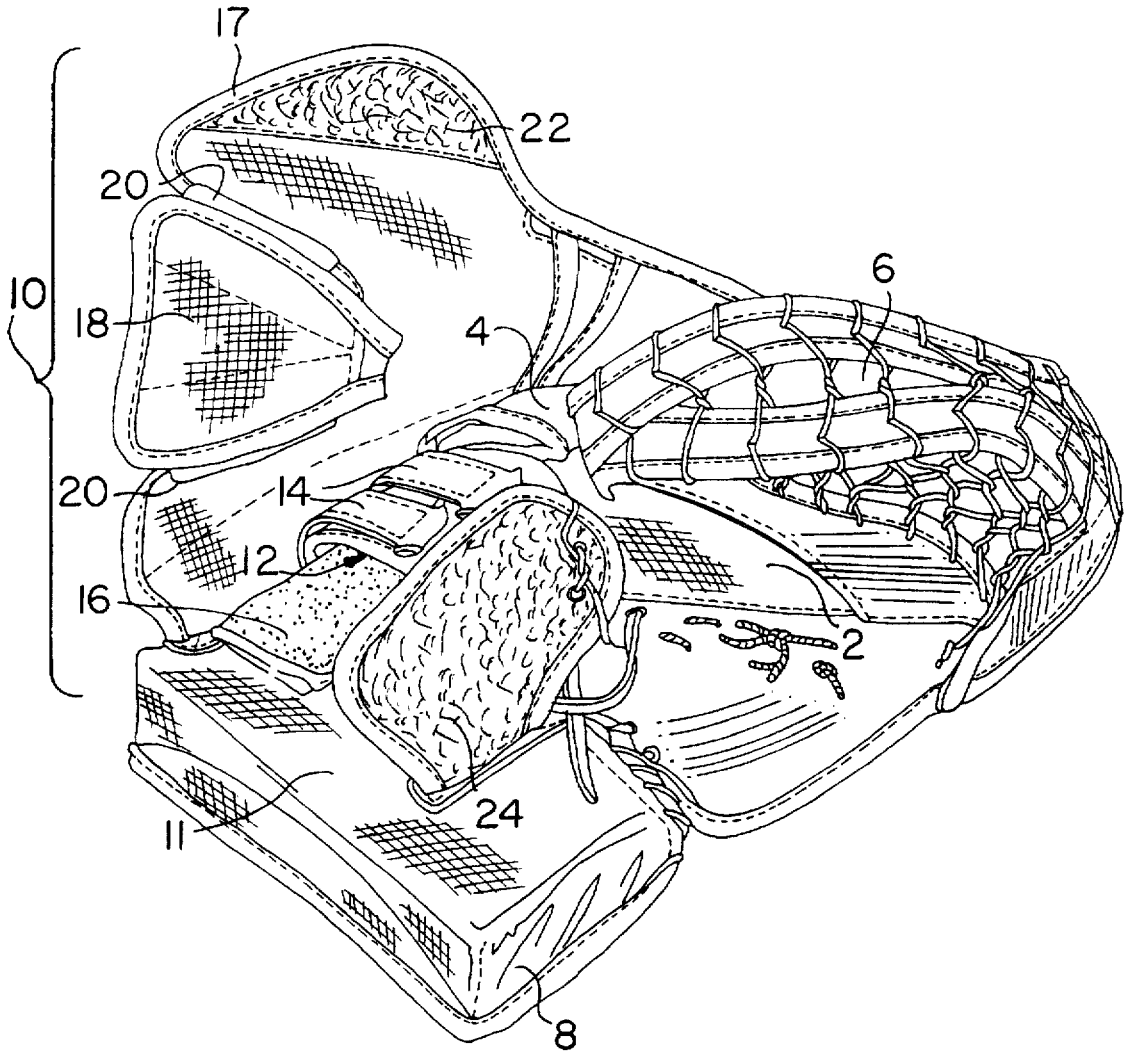
FIG. 3 is a perspective of the back of the glove, showing the cuff opened.

The second cuff portion 10 comprises a second protective element 18 which is connected to 9 first protective elements via elastic webbing 20. The first protective element 17 normally partially overlaps the second protective element 18, to provide substantially normal protection for the wrist and forearm area. However, as shown in FIG. 2, when the goaltender's hand is rotated backwardly towards the forearm 21 (shown in dotted lines in FIGS. 1 and 2), as when the goaltender is reaching down and flattening his hand against the ice, the second protective element 18 moves relative to the protective element 17, by virtue of the elastic webbing 20, so that there is minimal interference with this movement or other like movements.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, it should be appreciated that the second cuff portion could be sewn at both edges, or otherwise fastened, rather than being secured to the flap 11 via VELCRO.

I claim:

1. A hockey goaltender's glove for protecting a hand of a goaltender, said glove comprising:

a) a glove portion for receiving and enclosing the hand of the goaltender, said glove portion having a palm side and a back side, said glove portion comprising a finger receiving portion, a thumb receiving portion and a pocket located in between said finger receiving portion and said thumb receiving portion;

b) a first cuff portion attached to said glove portion, said first cuff portion being adjacent said palm side of said glove portion for protecting the palm side of the wrist and lower forearm of the goaltender; and c) a second cuff portion attached to said first cuff portion, said second cuff portion being adjacent said back side of said glove portion for protecting the back side of the wrist and lower forearm of the goaltender, said second cuff portion comprising a first protective element and a second protective element, said second protective element being movable relative to said first protective element to allow the goaltender to rotate the hand backwardly while maintaining protection.

2. A glove as claimed in claim 1 wherein said second protective element is movably connected to said first protective element via an elastic material.

3. A glove as claimed in claim 2 wherein said elastic material is an elastic webbing.

4. A glove as claimed in claim 3 wherein said first protective element partially overlaps said second protective element whereby providing better protection.

5. A glove as claimed in claim 3 wherein said second cuff portion is sewn to said first cuff portion on a first side and releasably attached to said first cuff portion on a second side.

6. A hockey goaltender's glove for protecting a hand of a goaltender, said glove comprising:

a) a glove portion for receiving and enclosing the hand of the goaltender, said glove portion having a palm side and a back side, said glove portion comprising a finger receiving portion, a thumb receiving portion and a pocket located in between said finger receiving portion and said thumb receiving portion;

b) a first generally rectangular cuff portion attached to said glove portion, said first cuff portion being adjacent said palm side of said glove portion for protecting the palm side of the wrist and lower forearm of the goaltender; and c) a second cuff portion attached to said first cuff portion, said second cuff portion being adjacent said back side of said glove portion for protecting the back side of the wrist and lower forearm of the goaltender, said second cuff portion comprising an elasticized element that undergoes extension when the hand of the goaltender is rotated backwardly, while maintaining protection.

7. A hockey goaltender's glove for protecting a hand of a goaltender, said glove comprising:

a) a glove portion for receiving and enclosing the hand of the goaltender, said glove portion having a palm side and a back side, said glove portion comprising a finger receiving portion, a thumb receiving portion and a pocket located in between said finger receiving portion and said thumb receiving portion: and b) a protective cuff portion attached to said glove portion for protecting the wrist and lower forearm of the goaltender wearing the glove, said protective cuff portion comprising first, second and third protective elements, said first and second protective elements being located on said back side whereas said third protective element is located on said palm side, wherein said second protective element is movable relative to said first protective element to allow the goaltender to rotate the hand backwardly while maintaining wrist protection.

* * * * *